US005342131A

United States Patent [19]

Nakajima et al.

[11] Patent Number: 5,342,131

[45] Date of Patent: Aug. 30, 1994

[54] TENSION BALANCER DEVICE FOR INK RIBBON

[75] Inventors: Takeshi Nakajima; Kazuhide Shiratori; Masahiro Uehara, all of Kanagawa, Japan

[73] Assignee: Sony Corporation, Japan

[21] Appl. No.: 47,275

[22] Filed: Apr. 19, 1993

[30] Foreign Application Priority Data

Apr. 24, 1992 [JP] Japan ..... 4-129734
May 25, 1992 [JP] Japan ..... 4-156188

[51] Int. Cl.[5] ..... B41J 3/02

[52] U.S. Cl. ..... 400/120.01; 346/76 PH; 400/234

[58] Field of Search ..... 400/120, 247, 248, 208, 400/208.1, 196; 346/76 PH

[56] References Cited

U.S. PATENT DOCUMENTS 4,621,270 11/1986 Mizutani et al. ..... 400/208
4,750,007 6/1988 Suzuki ..... 400/208
5,128,763 7/1992 Sakuragi ..... 400/208
5,209,587 5/1993 Herbert et al. ..... 400/208

FOREIGN PATENT DOCUMENTS 339933 9/1959 Switzerland ..... 10/247

OTHER PUBLICATIONS

"Uniform Ribbon Tension for Impact Printer Ribbon" Xerox Disclosure Journal, vol. A, No. 2, Mar. 4, 1979 pp. 181–182.

*Primary Examiner*—Eugene H. Eickholt
*Attorney, Agent, or Firm*—Ronald P. Kananen

[57] ABSTRACT

A tension balancer is disclosed for an ink ribbon adapted for a printer for thermally transferring an image onto the printing paper while moving the ink ribbon together with the printing paper, the printer including: a platen for moving a piece of printing paper wound around the platen; and a thermal head for pressingly contacting the ink ribbon, interposed between a supply reel and a take-up reel, against the printing paper on an outer circumference of the platen. The tension balancer contacts at its end face with the ink ribbon over a full width of the ink ribbon for applying tension to the ink ribbon. The tension balancer is substantially in the form of a plate. At least one projection may be provided on the end face of the tension balancer.

11 Claims, 17 Drawing Sheets

TENSION BALANCER DEVICE FOR INK RIBBON

BACKGROUND OF THE INVENTION

The present invention relates to an ink ribbon tension device suitable for a color printer for thermally transferring a color image onto a printing paper by using an ink ribbon, and more particularly relates to a tension balancer device for an ink ribbon.

A conventional color printer is shown in FIG. 1. An ink ribbon 1 onto which sublimate dyes such as yellow, magenta and cyan (three primary colors) are applied in a repeated pattern at a constant pitch is used in the color printer.

The ink ribbon 1 is wound between a supply reel 2 and a take-up reel 3 and is interposed between a platen 4 and a thermal head 5. A piece of printing paper (i.e., sensitive paper) 6 is loaded while being wrapped around an outer circumference of the platen 4 by a pair of pinch rollers 7. Then, a dye applied surface 1*a* of the ink ribbon 1 is brought into intimate contact with the printing paper 6 on the outer circumference of the platen 4 in a direction indicated by allow a by the thermal head 5.

In a first printing process, the platen 4 is drivingly rotated in a direction indicated by an arrow b through a constant pitch, and the printing paper 6 is moved at a constant pitch in the direction b. In this case, the ink ribbon 1 is fed at the same pitch as that of the printing paper 6 in a direction, indicated by an arrow c, by a frictional torque between the printing paper 6 and the ink ribbon 1. In synchronism with this, the take-up reel 3 is drivingly rotated in a direction, indicated by an arrow d, through a torque limiter, thereby taking up the ribbon 1 therearound in the direction d. By the first printing process, the yellow dyes of the ink ribbon are sublimated and at the same time thermally transferred onto the printing paper 6 by the heating action of the thermal head 5, so that a yellow image is printed on the printing paper 6. Subsequently, after the thermal head 5 has been separated away from the paper 6 in the direction a', the platen 4 is drivingly rotated in the reverse direction, indicated by an arrow b', through a constant pitch, so that only the printing paper 6 is once returned in the direction indicated by an arrow b'. Then, the thermal head 5 is again pressed against the paper 6 in the direction a, and the planten 4 is again drivingly rotated in the direction b at the constant pitch to thereby effect a second printing process.

By the second printing process, the magenta dyes of the ink ribbon are sublimated and at the same time thermally transferred onto the printing paper 6 by the heating action of the thermal head 5, so that a magenta image is superimposed on the yellow image on the printing paper 6.

In the same manner, a third printing process is effected. Cyan dyes of the ink ribbon 1 are sublimated and at the same time thermally transferred onto the printing paper 6 by the heating action of the thermal head 5, so that a cyan image is superimposed on the yellow and magenta image on the printing paper 6 and finally a synthetic color image is printed on the printing paper 6 with the yellow, magenta and cyan dyes.

However, in the color printer shown in FIG. 1, there is no tension balancer for balancing a tension in a traverse direction of the ink ribbon 1 fed out in the direction c away from the platen 4. Accordingly, in the case where path lengths between opposite edges in the widthwise direction of the ink ribbon 1 between the platen 4 and the take-up reel 3 are different from each other due to non-uniformity in mechanical part precision and assembling precision, when the ink ribbon 1 is wound in the direction d by the take-up reel 3, a tension (i.e., take-up force), applied to opposite edges in the widthwise direction of the ink ribbon, in the direction c would be unbalanced.

As a result, the ink ribbon 1 is obliquely wound around the take-up reel 3, so that creases would be generated in the ink ribbon 1. Otherwise, an oblique drive torque would be applied to the printing paper 6 by the ink ribbon which is being obliquely wound, so that the printing paper 6 would obliquely travel around the outer circumference of the platen, resulting in generation of deformation or distortion in the thermally transferred color image.

On the other hand, in the color printer shown in FIG. 1, also, there is no tensioning means for imparting a tension in the widthwise direction of the ink ribbon 1 fed out in the direction c away from the platen 4. Accordingly, as shown in FIG. 2, creases 9 along the length of the ink ribbon 1 are likely to be generated when the ink ribbon 1 is wound while imparting a tension in the direction d of the ink ribbon 1 by the take-up reel 3. Incidentally, if the tension applied to the ink ribbon 1 would be too strong or too week, then the creases 9 would be generated. Although a suitable tension exists, since in general the take-up reel 3 is wound at the constant torque and the tension of the ink ribbon 1 would be changed in accordance with a change in winding diameter of the ink ribbon 1, it would be difficult to wind the ink ribbon 1 at a constant tension. The conventional printer also suffers from an adverse affect such that the creases 9 along the length of the ink ribbon 1 would cause linear stains to occur on the printing paper 6.

In other conventional color printers, as shown in FIG. 3, a barrel-shaped roller 8 is interposed between the platen 4 and the take-up reel 3 to thereby effect an automatic centering operation of the ink ribbon 1. Even with this system, it would be impossible to well balance the tension (i.e., take-up force), applied to the opposite edges in the widthwise direction of the ink ribbon 1, in the direction c. Also, since the diameter of the barrel-shaped roller 8 has to be increased to some extent, the system needs a large mounting space, which would lead to the physical enlargement of the system, and an unduly strain would be likely to be generated in the path of the ink ribbon 1.

SUMMARY OF THE INVENTION

In view of the foregoing defects, a primary object of the present invention is to provide a tension balancer by which the tension in the transveral direction between the opposite edges of the ink ribbon is well balanced.

Another object of the invention is to provide a tension device in which, when an ink ribbon is wound around a take-up reel, there are no creases in the longitudinal direction in the ink ribbon.

According to one aspect of the invention, there is provided a tension device for an ink ribbon adapted for a printer for thermally transferring an image onto the printing paper while moving the ink ribbon together with the printing paper, the printer including: a platen for moving a piece of printing paper wound around the platen; and a thermal head for pressingly contacting the ink ribbon, interposed between a supply reel and a take-up reel, against the printing paper on an outer circumference of the platen; the tension device comprising: a tension applying means contacting at its end face with the ink ribbon over a full width of the ink ribbon for applying tension to the ink ribbon, the tension applying means being substantially in the form of a plate; wherein at least one projection is provided on the end face of the tension applying means.

According to the invention, the pivot is integrally formed with a support plate mounted on a chassis.

Alternatively, the pivot may be integrally formed with a support plate integrally formed with the thermal head.

The ribbon balancer may be loosely fitted to the support plate, the ribbon balancer being made in a thin plate having a U-shaped cross section.

According to still another aspect of the invention, there is provided a tension balancer for an ink ribbon adapted for a printer for thermally transferring an image onto the printing paper while moving the ink ribbon together with the printing paper, the printer including: a platen for moving a piece of printing paper wound around the platen; and a thermal head for pressingly contacting the ink ribbon, interposed between a supply reel and a take-up reel, against the printing paper on an outer circumference of the platen; the tension balancer comprising: means for balancing transversal tension of the ink ribbon, the tension balancing means being interposed between the platen and the take-up reel, the tension balancing means including: a ribbon balancer which is brought into contact with the ink ribbon over its full width; and a pivot disposed on a transveral center of the ink ribbon for rotatably supporting the ribbon balancer in a direction substantially perpendicular to the ink ribbon.

In this case, it is preferable that the tension applying means is rotatably supported about the pivot arranged on a transversal center of the ink ribbon.

The projection includes two projections arranged at the same distance from a transveral center of the ink ribbon on the tension applying means.

DESCRIPTION OF THE PREFERRED EMBODIMENTS

Figure 1:
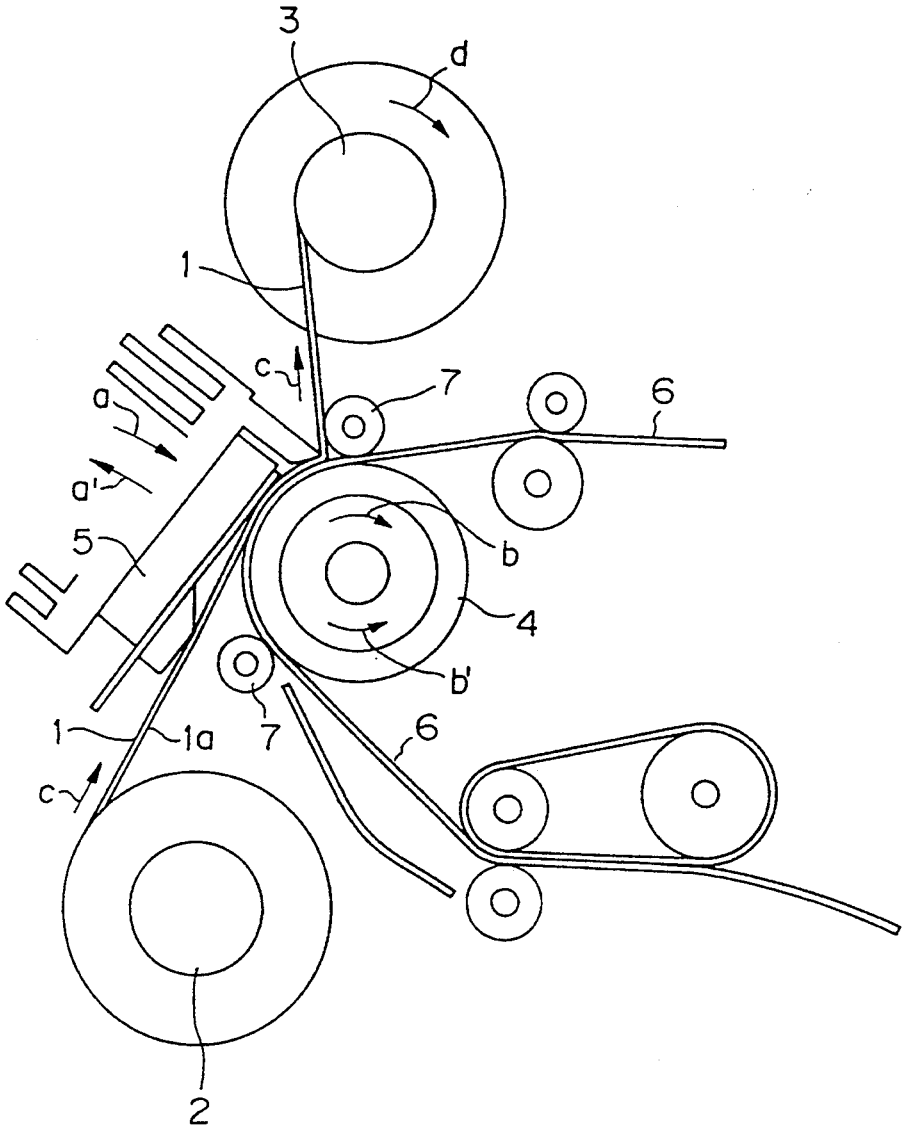
FIG. 1 PRIOR ART
FIG. 1 is a side elevational view showing a conventional color printer.
Figure 2:
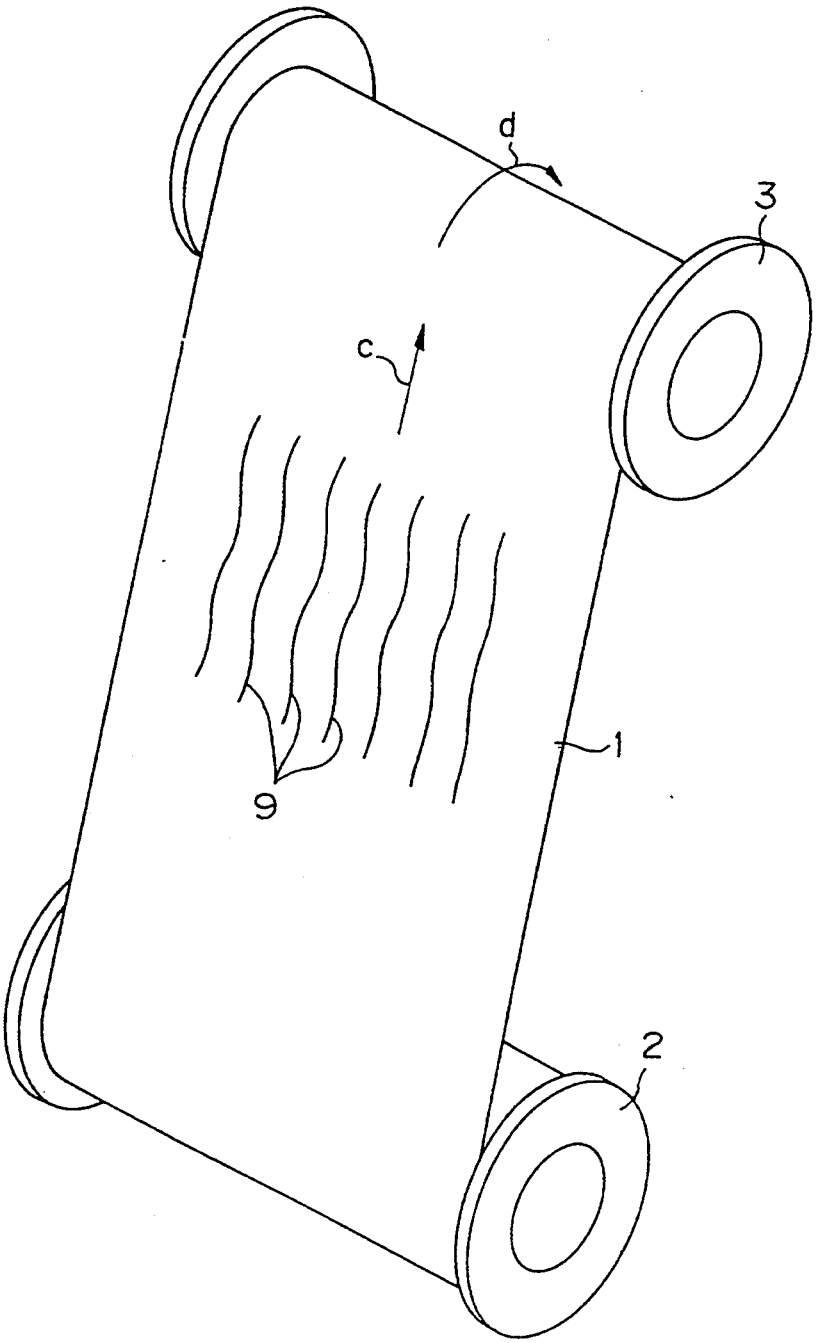
FIG. 2 PRIOR ART
FIG. 2 is a perspective view illustrating creases in an ink ribbon.
Figure 3:
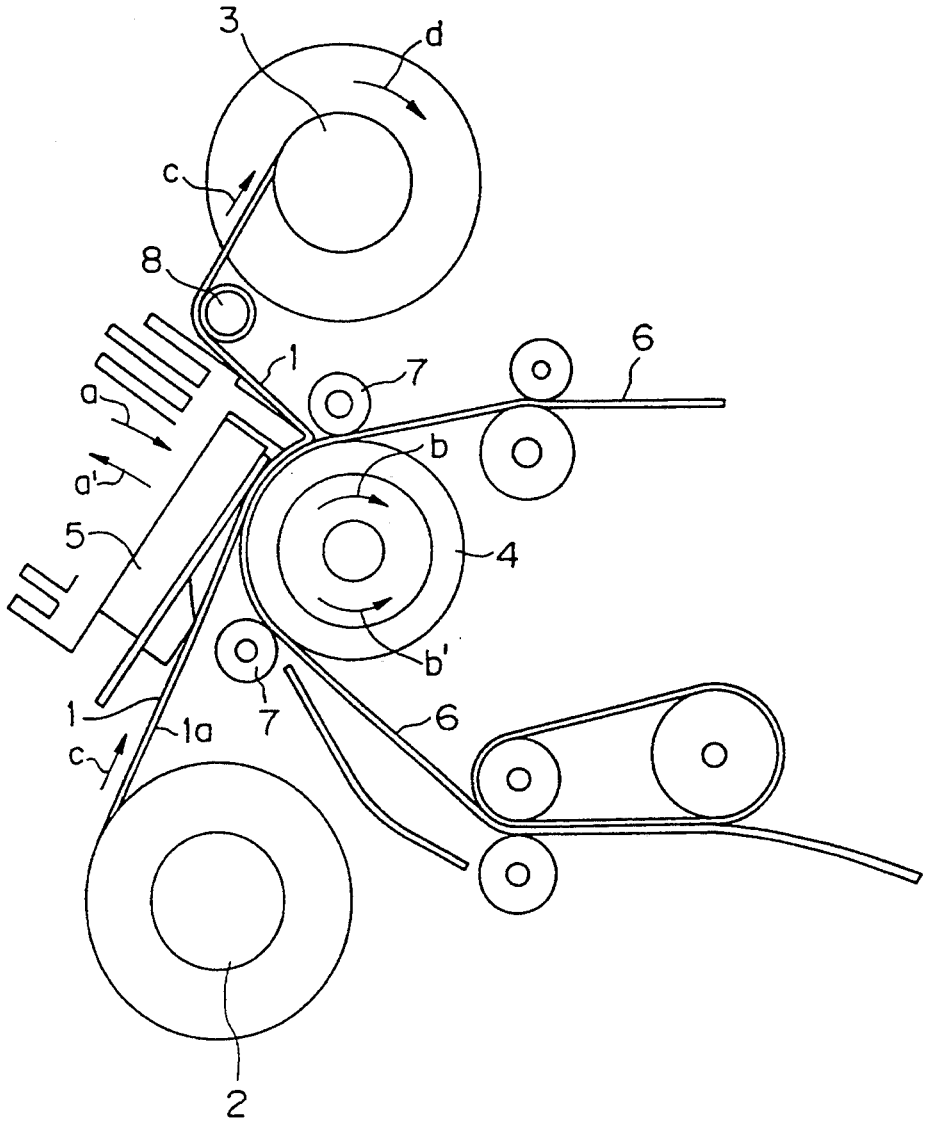
FIG. 3 PRIOR ART
FIG. 3 is a side elevational view showing a barrel-shaped roller in the conventional color printer.

An ink ribbon tension balancer applied to a color printer according to the invention will now be described with reference to FIGS. 4 through 10 in which the same reference characters as those used in FIGS. 1 to 3 are used to designate the like components and members, and the duplication of explanation therefor will be avoided. A first embodiment of the invention will first be described with reference to FIGS. 1 to 5.

Figure 5:
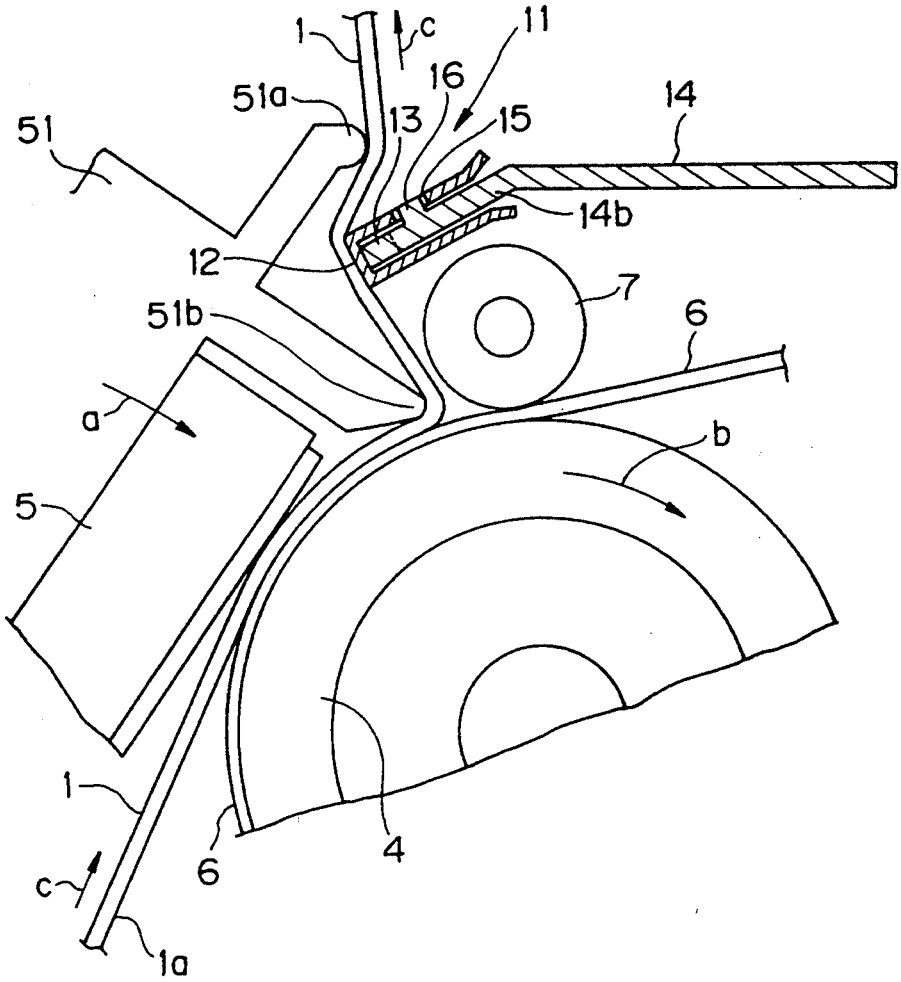
FIG. 5 is a side elevational sectional view showing a primary part of the first embodiment.

As shown in FIG. 5, a tension balancer 11 is interposed between a platen 4 and a take-up reel 3 on the side of a dye applied surface 1*a* of an ink ribbon for balancing a tension in a transverse or widthwise direction of the ink ribbon 1. The ink ribbon 1 is depressed against the tension balancer 11 over a full width thereof by a pair of ink ribbon pressing plates 51*a* and 51*b* which are perpendicular to each other and are integrally formed at an upper side of a heat sink 51 formed integrally with a thermal head 5 to be depressed toward the platen 4 in the direction a.

As shown in FIGS. 4 to 7, the tension balancer 11 has a ribbon balancer 12 which is to be brought into contact with the ink ribbon 1 over its full width substantially at a right angle, and a pivot 13 for rotatably supporting the ribbon balancer 12 at a center P of the transverse direction of the ink ribbon in directions, indicated by arrows e and f.

The pivot 13 is integrally formed in a substantially semicircular portion in the middle of a front edge face 14*a* of a support plate 14 which is mounted horizontally on a chassis (not shown) by fastening means such as rivets or screws. A free edge portion 14*b* of the support plate 14 is disposed obliquely downwardly so as to be substantially perpendicular to the ink ribbon 1.

The ribbon balancer 12 is formed by a thin plate made of stainless steel or the like and bent to have a ribbon contact portion 120 and a pair of upper and lower mounting pieces 121 in the form of a U-shape in cross section.

The ribbon balancer 12 is loosely fitted to upper and lower sides of the free edge portion 14*b* of the support plate 14 by the pair of upper and lower mounting pieces 121. A projection 16 which has a smaller diameter and formed integrally with the upper central portion of the pivot 13 of the support plate 14 is loosely engaged with a hole which has a larger diameter and formed in the central portion of the upper mounting piece 121. Thus, the ribbon balancer 12 is brought into contact with the pivot 13 at the central portion of the inner surface of the ribbon contact portion 120, and the ribbon balancer 12 is rotatably supported about the pivot 13 in a seesaw-like manner in the directions e and f which are substantially perpendicular to the ink ribbon 1. Incidentally, it should be noted that the projection 16 solely functions to prevent the ribbon balancer 12 from falling apart therefrom but the projection 16 does not affect the rotational motion of the ribbon balancer 12 in the directions e and f at all.

Figure 4:
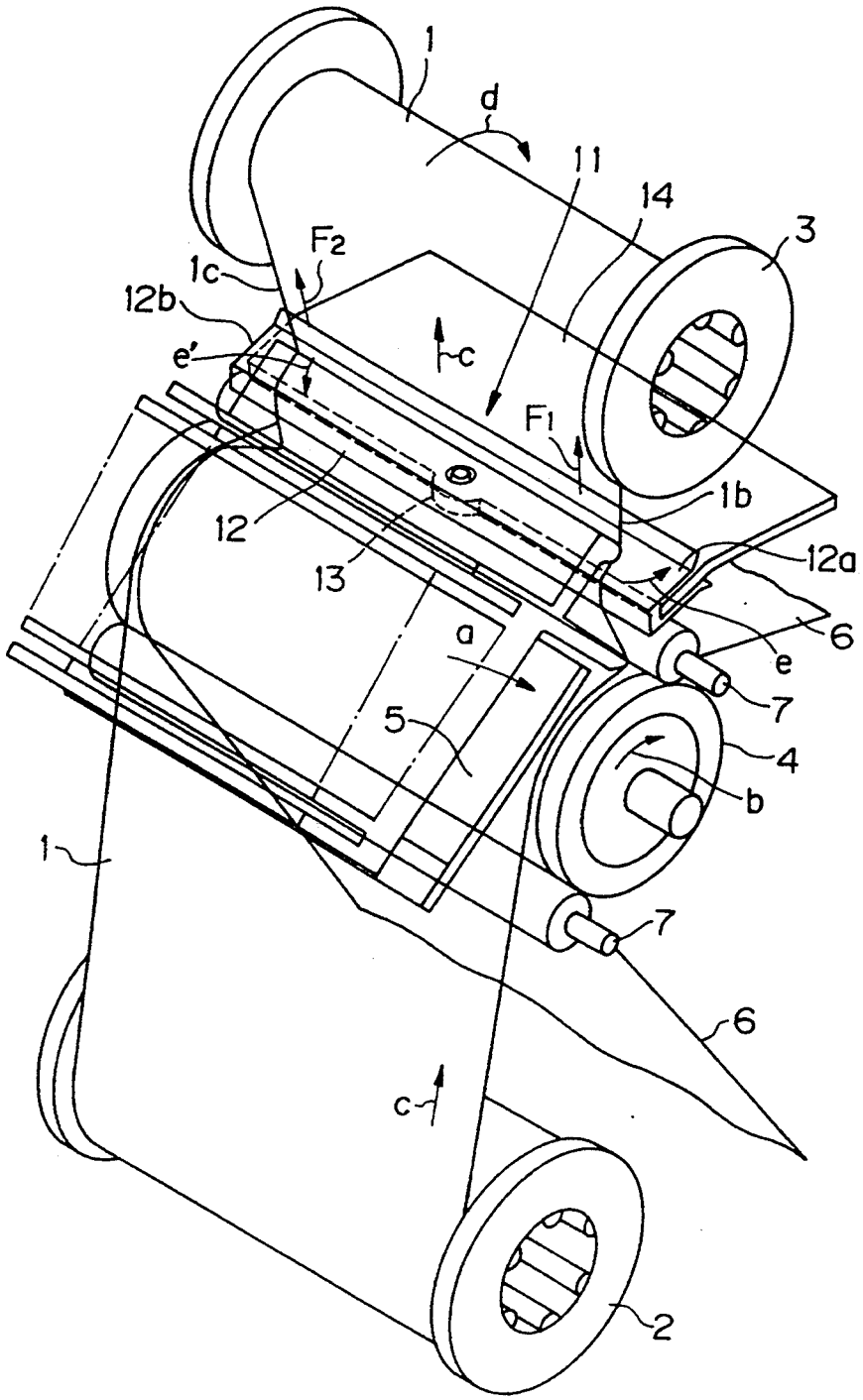
FIG. 4 is a perspective view showing a tension balancer for an ink ribbon for a color printer to which the present invention is applied.
Figure 8:
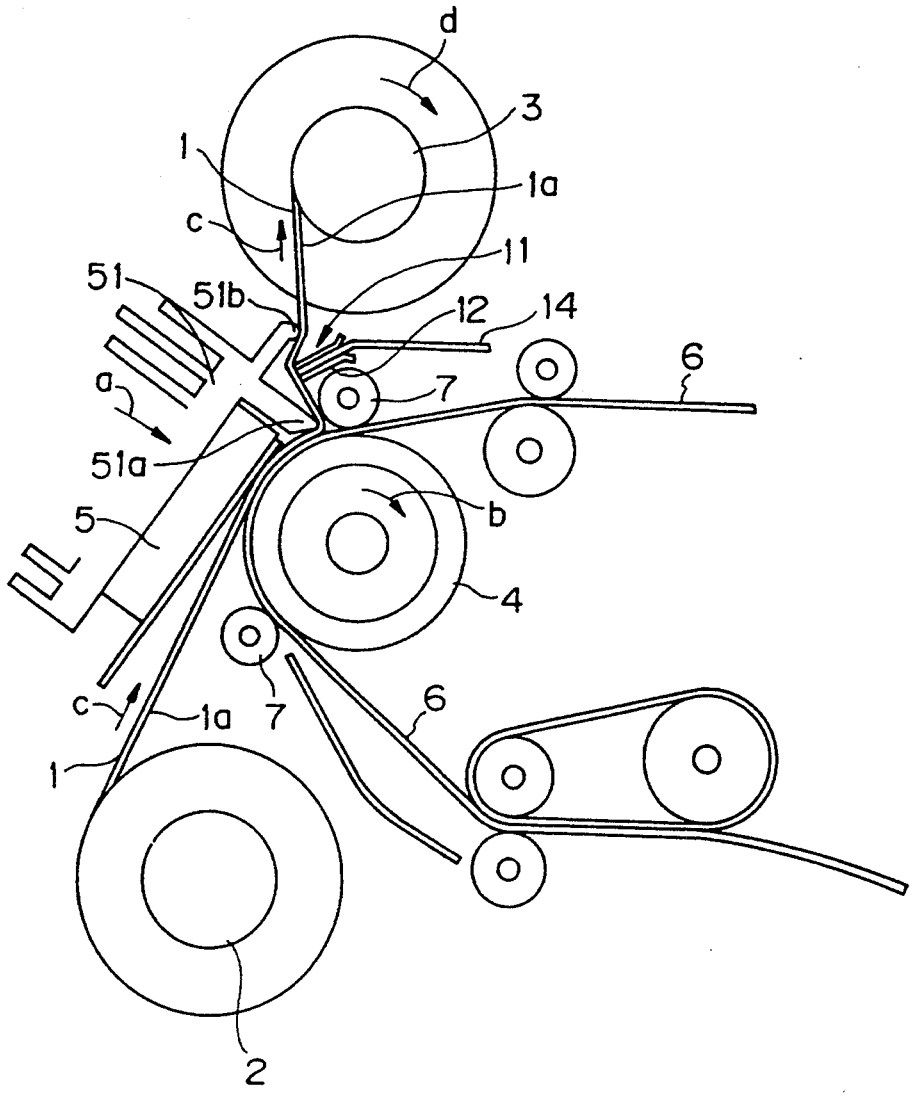
FIG. 8 is a side elevational view showing the entire portion of the first embodiment of the invention.

With the thus arranged tension balancer 11, as shown in FIGS. 4 and 8, during the printing operation of the color printer, when the thermal head 5 causes the ink ribbon 1 to pressingly contact in the direction a against the printing paper 6 loaded around the circumferential surface of the platen 4, the ink ribbon 1 is brought into contact with the ribbon contact portion 120 of the ribbon balancer 12 over the full width substantially at a right angle by the pair of upper and lower ink ribbon pressing plates 51*a* and 51*b*.

As described above, by the driving rotation of the platen 4 in the direction b, the printing paper 6 and the ink ribbon 1 are fed together in the directions b and c to thereby print a color image through thermal transfer. When the ink ribbon 1 is wound in the direction d by the take-up reel 3, the tension balancer 11 may automatically balance the tension (i.e., winding force) in the transverse direction of the ink ribbon 1.

Figure 6:
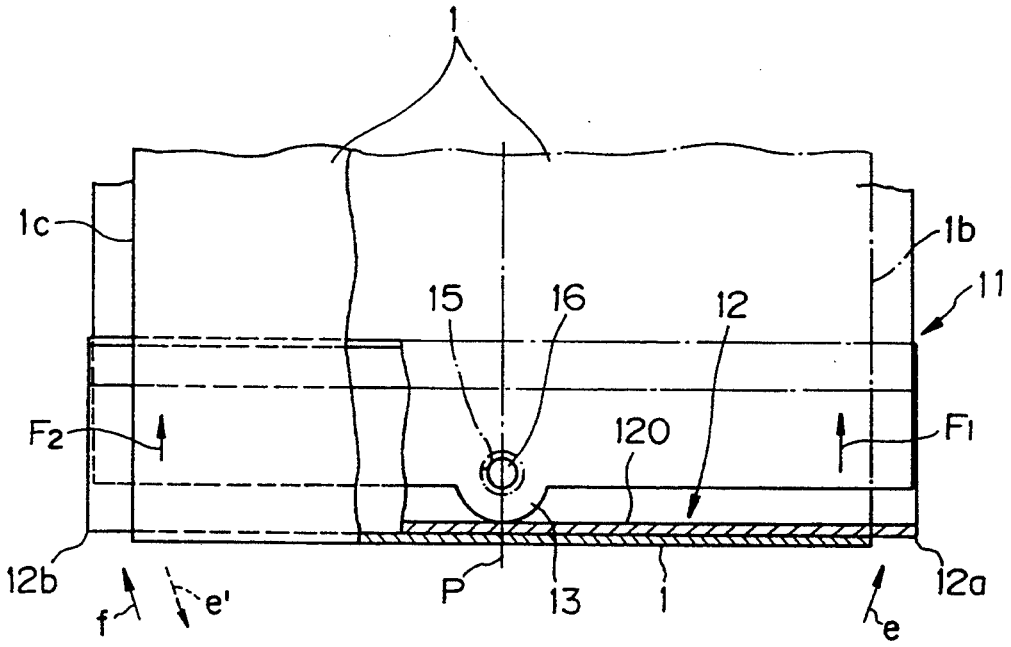
FIG. 6 is a fragmentary plan view showing the primary part of the first embodiment.
Figure 7:
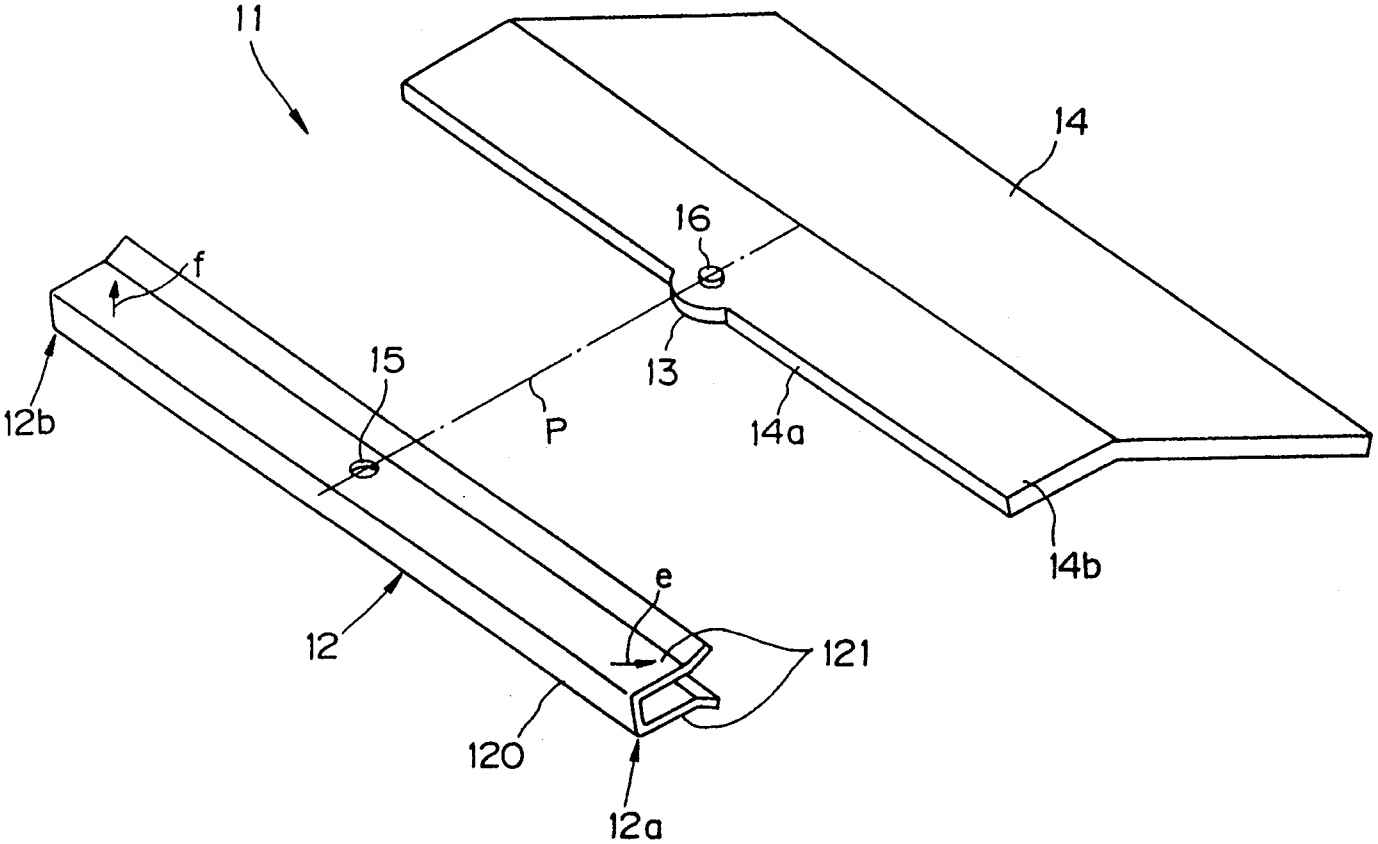
FIG. 7 is an exploded view showing the primary part of the first embodiment.

More specifically, as shown in FIGS. 4 and 6, when the tension F1 on one side 1*b* in the transverse direction of the ink ribbon 1 to be wound in the direction d on the take-up reel 3 is increased, a portion of the ribbon balancer 12 on one side 12*a* is rotated about the pivot 13 in a seesaw-like manner in the direction e by the ink ribbon 1. Then, the other portion of the ribbon balancer 12 on the other side 12*b* is rotated about the pivot 13 in a seesaw-like manner in the direction e', so that the tension F2 on the other side 1*c* in the transverse direction of the ink ribbon 1 is increased by the ribbon balancer 12. Then, the ribbon balancer 12 will be stable at a position where the tensions F1 and F2 of the opposite edges 1*b* and 1*c* of the transverse direction of the ink ribbon 1 are automatically well balanced.

Accordingly, the ribbon balancer 12 is freely rotated in the directions e and f in response to the change of balance between the tensions F1 and F2 of the opposite transversal edges 1*b* and 1*c* of the ink ribbon 1, so that the tensions F1 and F2 of the opposite transversal edges 1*b* and 1*c* of the ink ribbon 1 may be automatically well balanced.

As a result, the change of balance between the tensions F1 and F2 of the opposite transveral edges 1*b* and 1*c* of the ink ribbon 1 can obviate such a fear that the ink ribbon 1 would be obliquely wound around the take-up reel 3 to generate "creases" in the ink ribbon 1 or the ink ribbon 1 wound obliquely on the take-up reel 3 would impart an oblique drive force to the printing paper 6 to cause the printing paper 6 to travel obliquely along the outer circumference of the platen 4 to generate distortion or deformation on a color image to be thermally transferred to the paper 6.

As described above, the tension balancer 11 in which the thin plate-like ribbon balancer made of stainless steel or the like and formed in a U-shape in cross section is loosely fitted to the upper and lower sides of the support plate 14 may be formed with a very small thickness as a whole and may be compact in size. Therefore, the space for mounting the tension balancer 11 may be saved and hence, the color printer as a whole may be made small in size. Also, since the support plate 14 is mounted on the chassis by the fastening means such as rivets or screws, the ribbon balancer 12 may be stably supported thereto.

Figure 9:
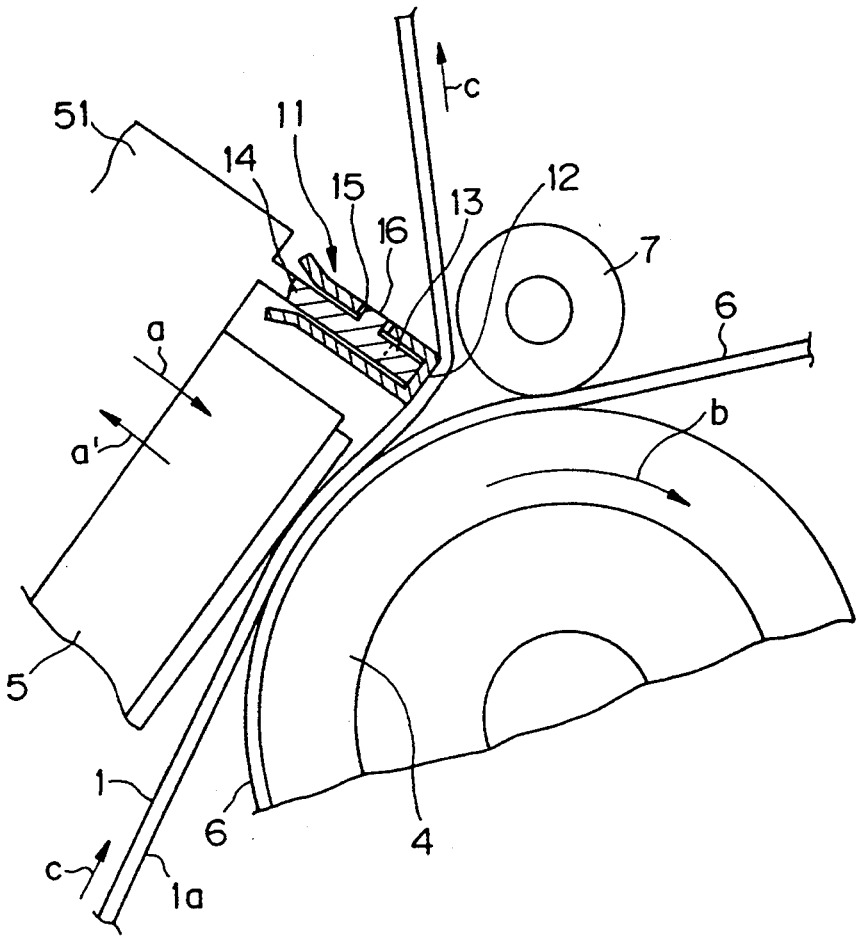
FIG. 9 is a side elevational sectional view showing a primary part of a second embodiment.
Figure 10:
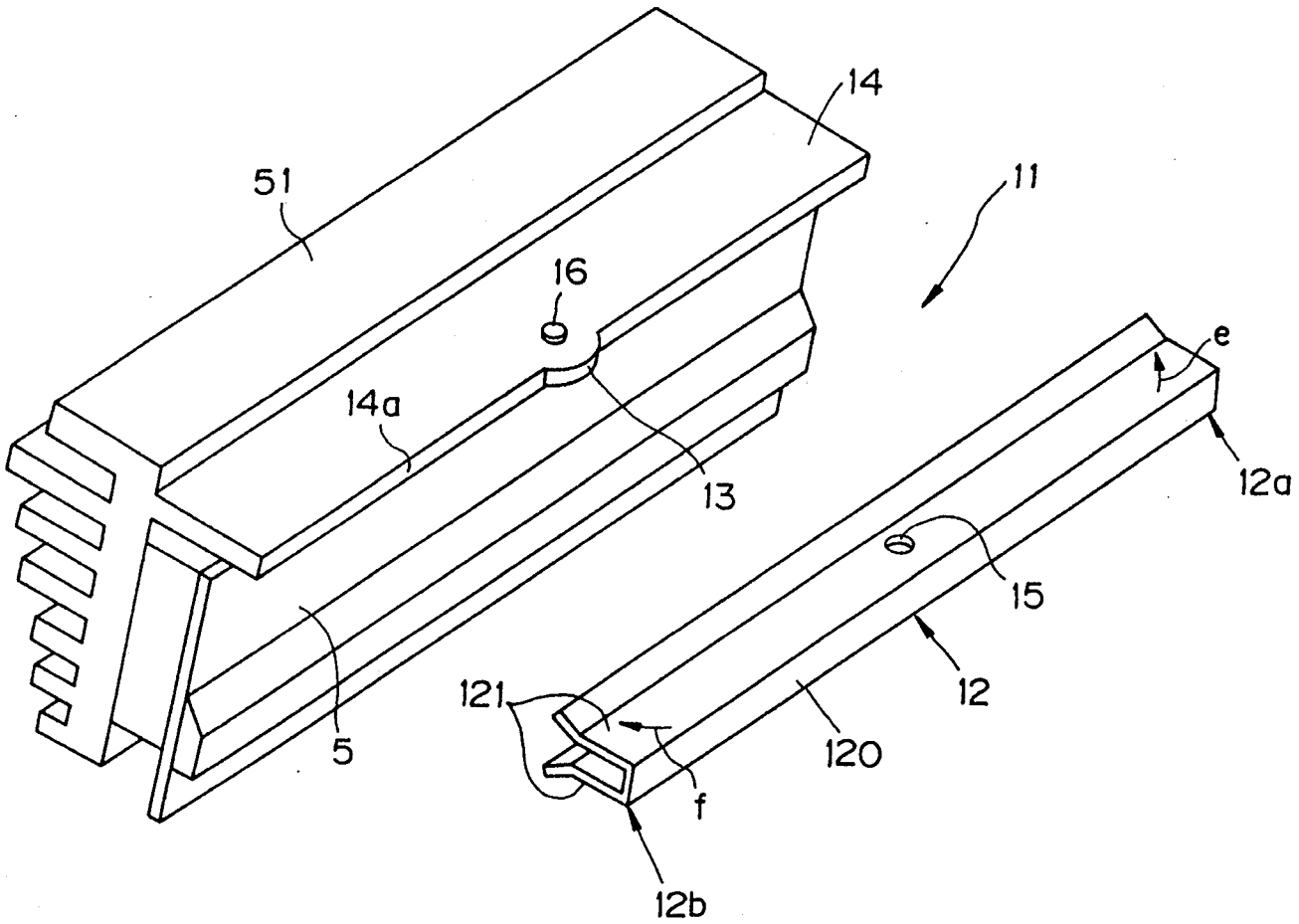
FIG. 10 is an exploded view showing a primary part according to a second embodiment.

Another tension balancer 11 according to a second embodiment of the invention will now be described with reference to FIGS. 9 and 10.

In the second embodiment, the tension balancer 11 has a support plate 14 which is integrally formed with an upper side of a heat sink 51 integrally formed with a thermal head 5. A substantially semicircular pivot 13 is integrally formed with the central portion of a front face 14*a* of the support plate 14. A ribbon balancer 12 having a U-shape in cross section is loosely fitted to the upper and lower sides of the support plate 14. The ribbon balancer 12 is rotatably supported about the pivot 13 in the directions e and f. As best shown in FIG. 9, when the thermal head 5 causes the ink ribbon 1 to pressingly contact in the direction a with the printing paper 6, wound around the outer circumference of the platen 4, the ribbon balancer 12 of the tension balancer 11 is depressed against the ink ribbon 1 over its full width substantially at a right angle.

The tension balancer 11 according to the second embodiment enjoys the same function and effect as those of the first embodiment. In particular, since the tension balancer 11 is mounted on the thermal head 5 side, the pressure contact action of the thermal head 5 toward the platen 4 may cause the ribbon balancer 12 to effectively contact with the ink ribbon 1. In addition, since the thermal head 5 also serves as a pressure means of the tension balancer 11 against the ink ribbon 1, it is possible to dispense with the pair of upper and lower ribbon pressing plates 51*a* and 51*b* shown in FIGS. 5 and 8, and moreover, when the thermal head 5 is separated away from the platen 4 in a direction a' in FIGS. 8 and 9, the tension balancer 11 may be also separated far away from the ink ribbon 1 to thereby facilitate the ink ribbon setting operation of setting or loading the ink ribbon 1 between the platen 4 and the thermal head 5.

The thus constructed ink ribbon tension balancer according to the invention may insure the following advantages.

According to one aspect of the invention, the ribbon balancer which is to be brought into contact with the ink ribbon over its full width is rotatably supported in a direction substantially perpendicular to the ink ribbon about the pivot arranged on a center of the ink ribbon, and when a tension at one edge of the transverse direction of the ink ribbon to be wound around the take-up reel is increased, immediately, the ribbon balancer is rotated about the pivot in a seesaw-like manner to thereby increase the tension at the other edge of the transverse direction of the ink ribbon. Accordingly, it is possible to automatically well balance between the tensions at the two edges of the transverse direction of the ink ribbon. It is therefore possible to obviate such a fear that the ink ribbon is obliquely wound around the take-up reel to generate the "creases" in the ink ribbon or the ink ribbon to be wound obliquely would impart an oblique drive force to the printing paper to cause the printing paper to run obliquely along the outer circumference of the platen to generate the distortion and deformation in a color image to be thermally transferred to the printing paper. Thus, the printing operation for the color image or the like may be well carried out with high precision.

According to another aspect of the invention, since the ribbon balancer is supported by the support plate mounted on the chassis, it is possible to stably support the ribbon balancer and to carry out the printing operation for the color image or the like with high precision.

According to still another aspect of the invention, since the ribbon balancer is supported to the support plate mounted on the thermal head, and the ribbon balancer is brought into contact with the ink ribbon in an effective manner by utilizing the contact operation of the thermal head against the platen, it is possible to also utilize the thermal head as the pressure contact means of the tension ballancer toward the ink ribbon, thereby simplifying the structure and facilitating the ink loading operation of setting the ink ribbon between the platen and the thermal head.

According to the invention, since the thin plate-like ribbon balancer having a U-shape in cross section is loosely fitted on both sides of the support plate to provide a thin and compact tension balancer, it is possible to save a space for mounting the tension balancer and to make the printer small in size as a whole.

A third embodiment of the invention will now be described with reference to FIGS. 11 to 14 in which the same reference characters as those used in FIGS. 1 through 10 are also used to designate the like components and members, the duplication of explanation therefor will be avoided.

In the same way as in the foregoing embodiments, a thin plate-like tension balancer 12 is made of stainless steel to have a U-shape in cross section. A pair of parallel upper and lower mounting pieces 121 are integrally formed with a substantially strip-shpaed end face 120. A pair of projections 122 are formed integrally with the end face 120 to have a height H by machining works such as drawing. The pair of projections 122 are located at positions P1 at the same distance L in the transverse direction of the tension balancer 12 from a center P of the transverse direction of the ink ribbon 1.

Figure 11:
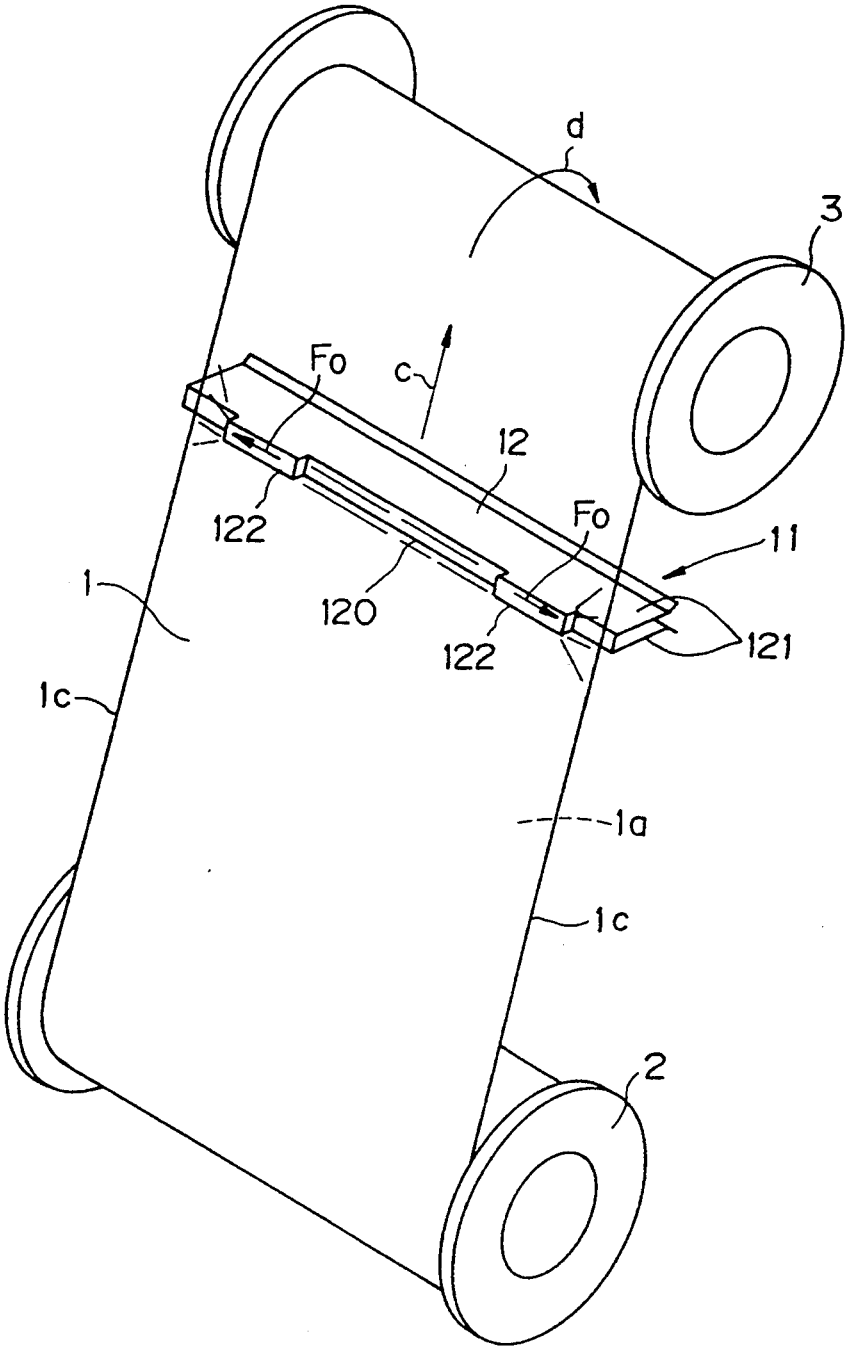
FIG. 11 is a schematic perspective view showing a tension device for an ink ribbon for a color printer in accordance with a third embodiment of the invention.

With the thus arranged tension device 11, as shown in FIG. 11, during the printing operation of the color printer, when the thermal head 5 causes the ink ribbon to pressingly contact in the direction a against the printing paper 6 loaded around the circumferential surface of the platen 4, the ink ribbon 1 is brought into contact with the pair of projections 122 and the end face 120 of the tension balancer 12 over the full width substantially at a right angle by the pair of upper and lower ink ribbon pressing plates 51*a* and 51*b*.

Figure 12:
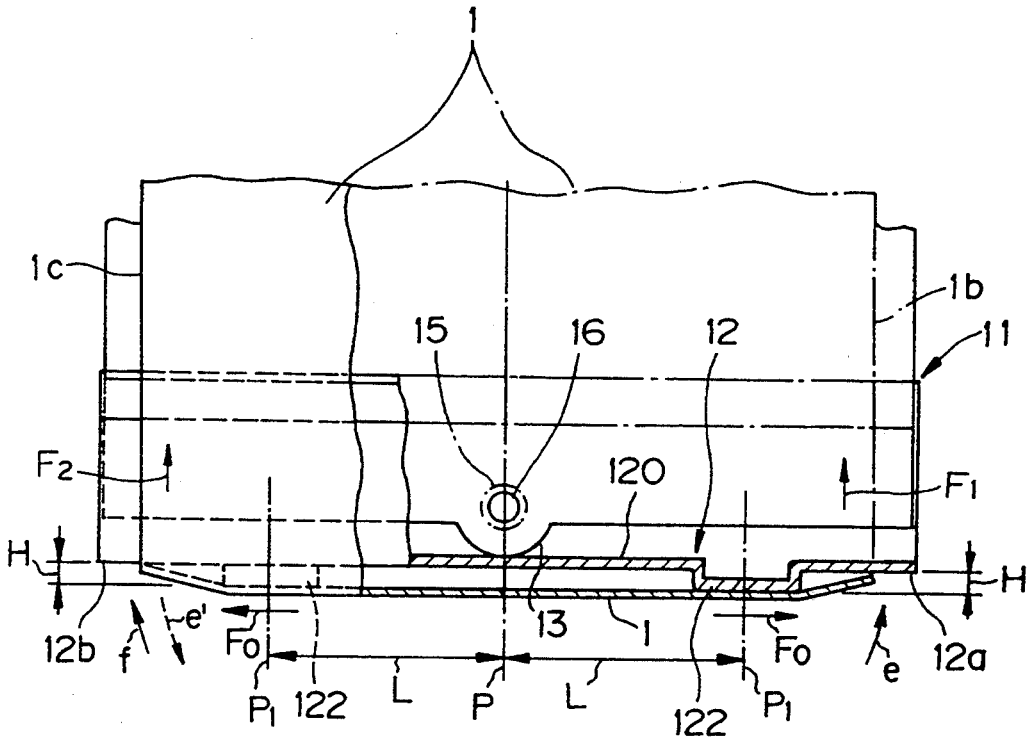
FIG. 12 is a partially fragmentary plan view showing a primary part of the tension device shown in FIG. 11.
Figure 13:
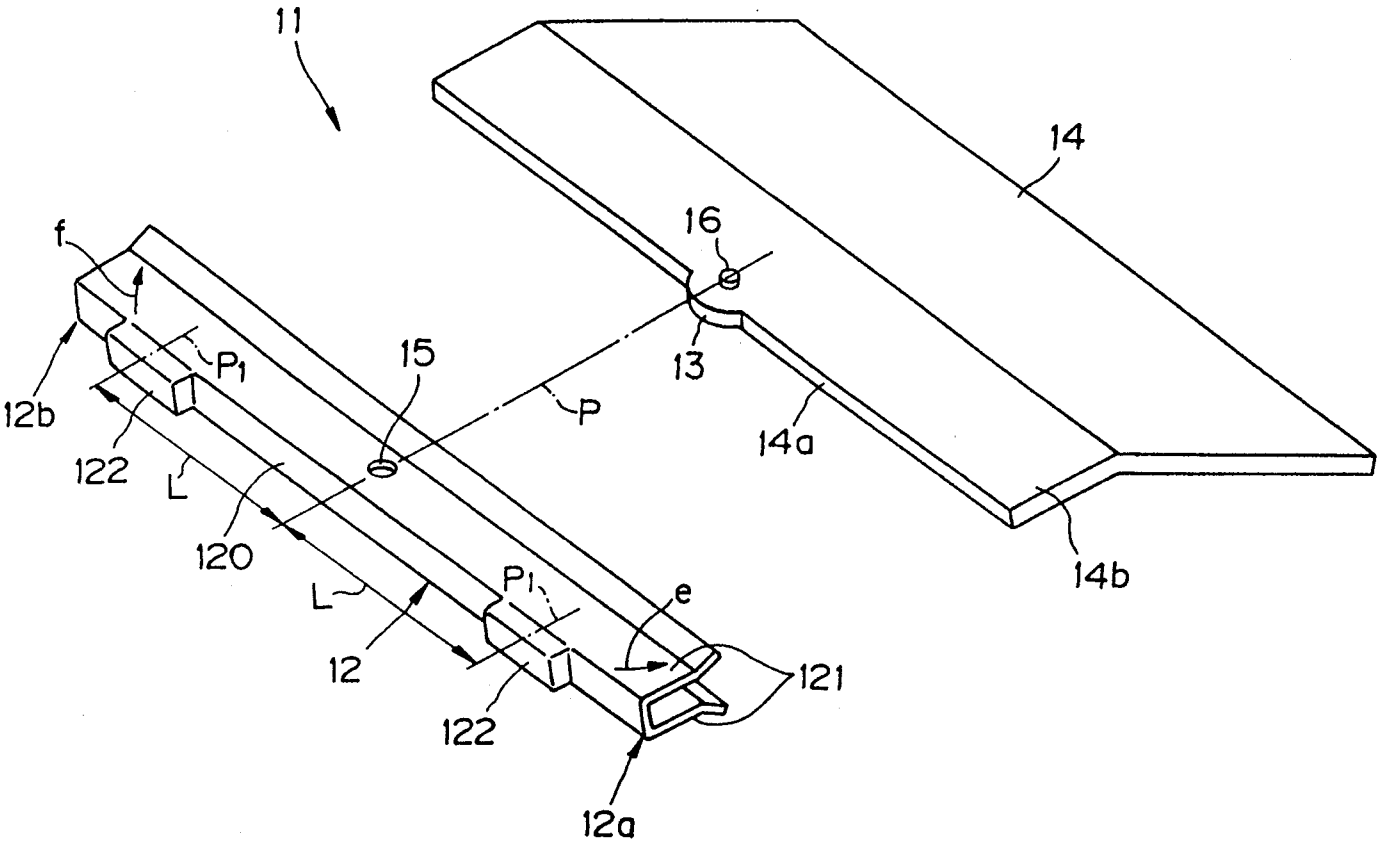
FIG. 13 is an exploded view showing the primary part shown in FIG. 11.
Figure 14:
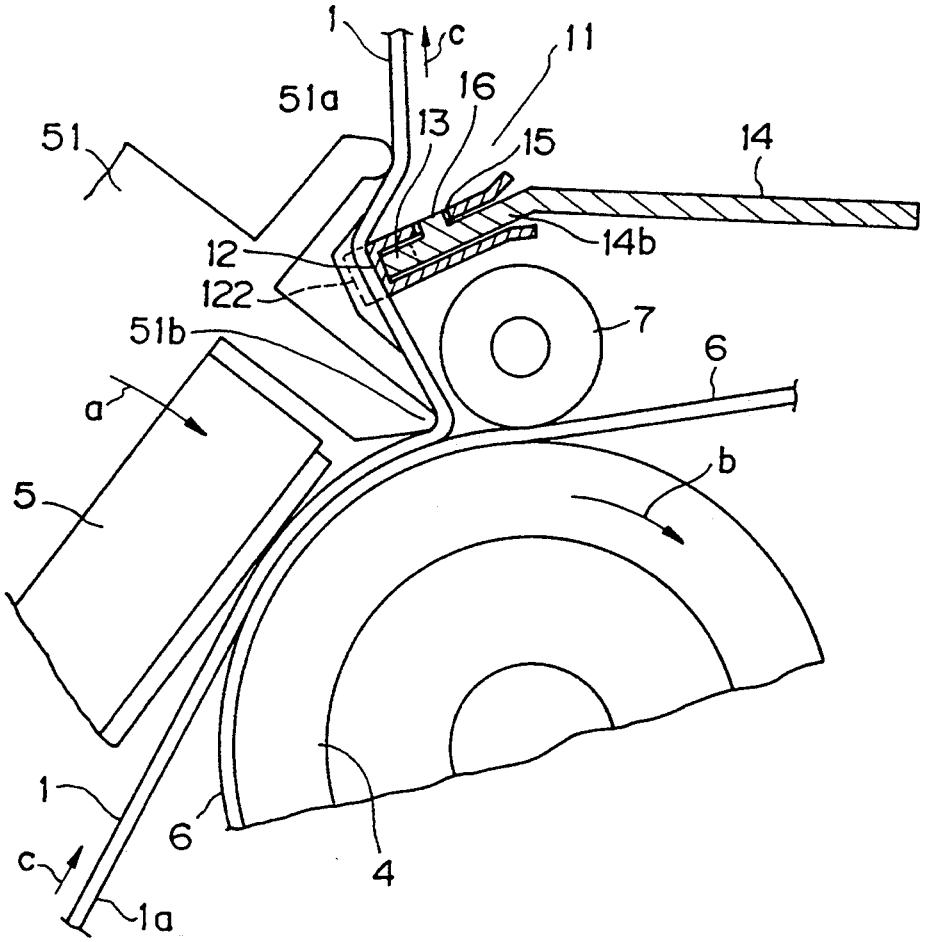
FIG. 14 is a side elevational sectional view showing the primary part shown in FIG. 11.

As shown in FIGS. 11 and 12, when the ink ribbon 1 is wound in the direction d, the ink ribbon 1 is depressed against the pair of projections 122 and the end face 120 of the tension balancer 12, so that sufficient tensions F0 are applied to the ink ribbon 1 in its transversal direction. By adjusting the height of the pair of projections 122, it is possible to adjust the magnitude of the tensions F0 in the transveral direction of the ink ribbon 1. Thus, since the sufficient tension F0 is applied to the ink ribbon 1 in the transversal direction, it is possible to positively remove the creases shown in FIG. 2. Accordingly, it is possible to obviate an adverse affect that the creases 9 generated in the ink ribbon 1 causes linear stains to occur in the printing paper 6. The transversal tension effect may be synergistically obtained in addition to the stable tension balancer effect between the forces F1 and F2.

Figure 15A:
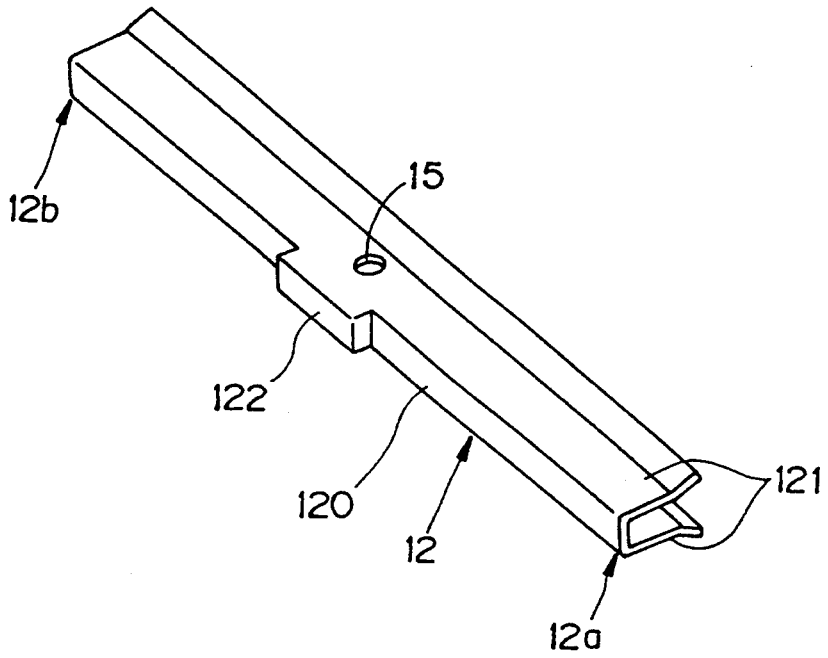
FIGS. 15A and 15B are perspective views showing modifications of the tension balancers.
Figure 15B:
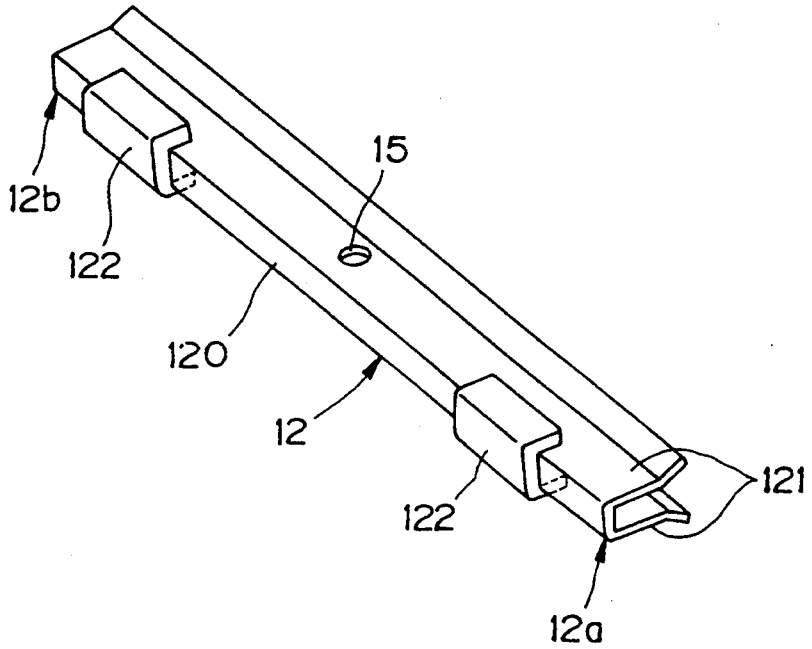

As shown in FIG. 15A, the tension balancer 12 may be a member integrally provided with a single projection 122 at the transveral center P of the ink ribbon. Also, the tension balancer may be made by attaching to the end face 12 of the tension balancer body 12 projections 122 which are made discretely from the tension balancer body 12 and which have a U-shaped cross section.

Figure 16:
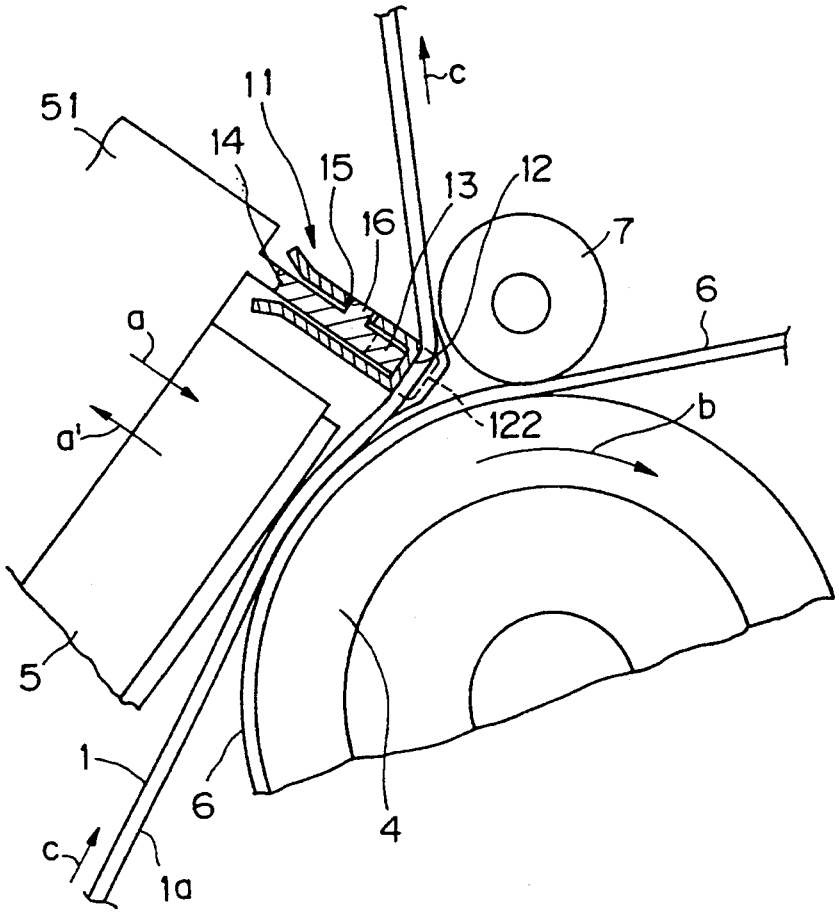
FIG. 16 is a side elevational sectional view showing a primary part of a fourth embodiment.
Figure 17:
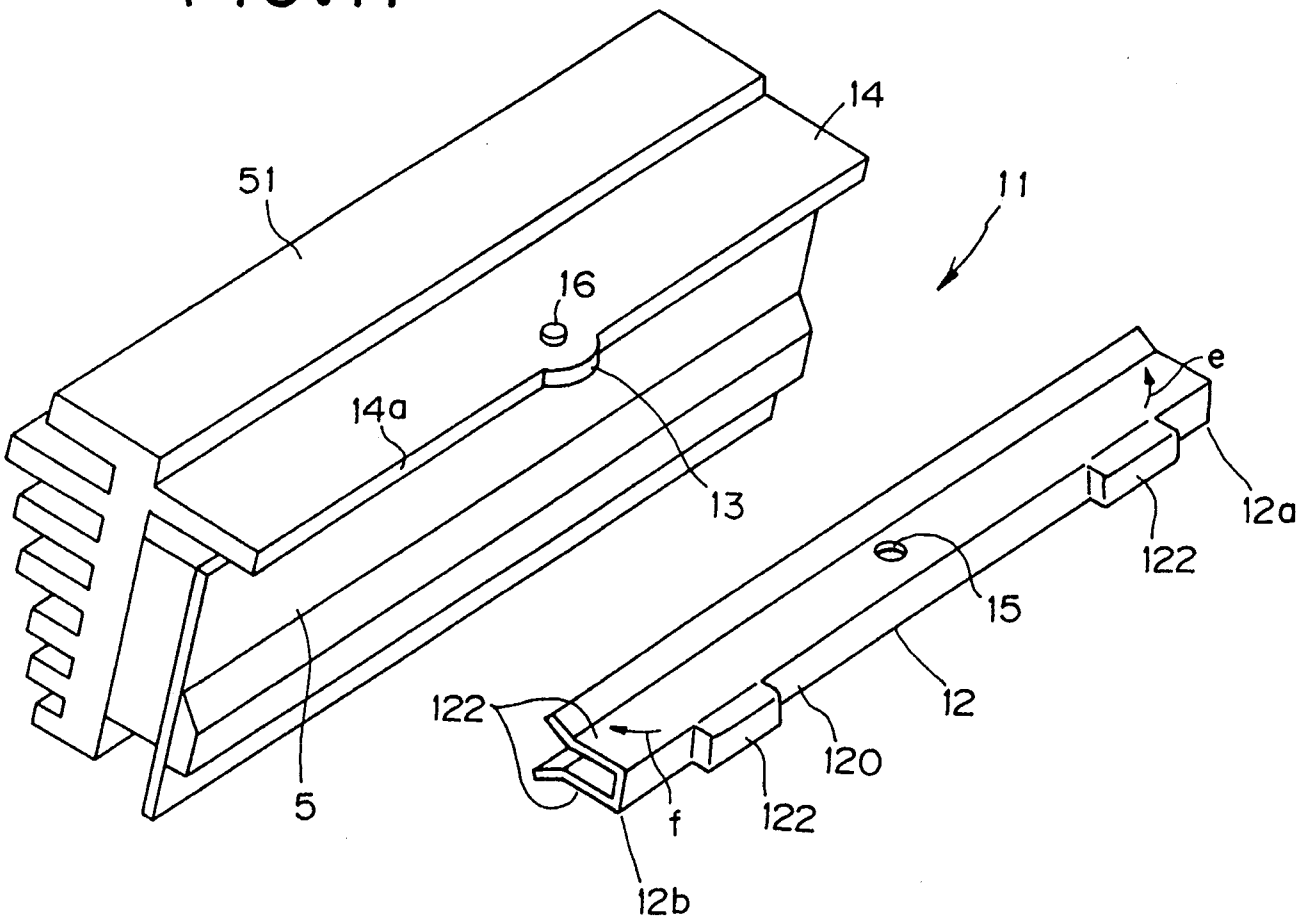
FIG. 17 is an exploded view showing the primary part of the fourth embodiment.

Subsequently, a tension device 11 according to a fourth embodiment will be described with reference to FIGS. 16 and 17.

In the fourth embodiment, the tension device 11 has a support plate 14 which is integrally formed with an upper side of a heat sink 51 integrally formed with a thermal head 5. A substantially semicircular pivot 13 is integrally formed with the central portion of a front face 14*a* of the support plate 14. A ribbon balancer 12 having a U-shape in cross section is loosely fitted to the upper and lower sides of the support plate 14. The ribbon balancer 12 is rotatably supported about the pivot 13 in the directions e and f. As best shown in FIG. 16, when the thermal head 5 causes the ink ribbon 1 to pressingly contact in the direction a with the printing paper 6, wound around the outer circumference of the platen 4, the ribbon balancer 12 of the tension device 11 is depressed against the ink ribbon 1 over its full width substantially at a right angle.

In the same manner as in the second embodiment, the tension device 11 according to the fourth embodiment enjoys the same function and effect as those of the first embodiment. In particular, since the tension device 11 is mounted on the thermal head 5 side, the pressure contact action of the thermal head 5 toward the platen 4 may cause the tension balancer 12 to effectively contact with the ink ribbon 1. In addition, since the thermal head 5 also serves as a pressure means of the tension device 11 against the ink ribbon 1, it is possible to dispense with the pair of upper and lower ribbon pressing plates 51*a* and 51*b* shown in FIG. 14, and moreover, when the thermal head 5 is separated away from the platen 4 in a direction a' in FIG. 16, the tension device 11 may be also separated far away from the ink ribbon 1 to thereby facilitate the ink ribbon setting operation of setting or loading the ink ribbon 1 between the platen 4 and the thermal head 5.

According to the third and fourth embodiments of the invention, since at least one projection is provided on a plate-like tension applying means which is to be brought into contact with the ink ribbon over its full width by the end face thereof, it is possible to obviate such an adverse affect that the winding action of the take-up reel for the ink ribbon would cause creases to occur in the longitudinal direction of the ink ribbon and hence, linear stains would be generated in the printing paper.

Since the tension applying means is substantially in the form of a plate and its thickness is very thin, it is possible to save the mounting space for the tension applying means within the printer in comparison with the conventional printer having a barrel-shaped roller, thus making the printer small in size and reducing its weight.

According to the third embodiment of the invention, the tension applying means which is to be brought into contact with the ink ribbon over its full width is rotatably supported in a direction substantially perpendicular to the ink ribbon about the pivot arranged on a center of the ink ribbon, and when a tension at one edge of the transveral direction of the ink ribbon to be wound around the take-up reel is increased, immediately, the tension balancer is rotated about the pivot in a seesaw-like manner to thereby increase the tension at the other edge of the transveral direction of the ink ribbon. Thus, when the ink ribbon is wound around the take-up reel, it is possible to obviate such a problem that the ink ribbon would be obliquely wound therearound and it is possible to stably wind the ink ribbon around the take-up reel.

If the two projections are arranged at the same distance from the transveral center of the ink ribbon on the tension applying means and the tension applying means is interposed between the platen and the take-up reel, it is possible to effectively apply transveral tension to the ink ribbon to insure reliability.

The present invention has now been described on the basis of the four embodiments and their modification, both the spirit of the invention is not limited thereto or thereby. Accordingly, it is possible for those skilled in the art to modify or change the embodiments of the invention within the scope of the appended claims.

What is claimed is:

1. A tension device for an ink ribbon adapted for a printer for thermally transferring an image onto the printing paper while moving the ink ribbon together with the printing paper, said printer including:

a platen for moving a piece of printing paper wound around the platen; and a thermal head for pressingly contacting the ink ribbon, interposed between a supply reel and a take-up reel, against the printing paper on an outer circumference of the platen;

said tension device comprising:

a tension applying means contacting at its end face with said ink ribbon over a full width of said ink ribbon for applying tension to said ink ribbon, said tension applying means being substantially in the form of a plate;

wherein at least one projection is provided on said end face of said tension applying means, and said tension applying means is supported rotatably about a pivot axis, arranged on a transversal center of said ink ribbon, which extends in a direction substantially perpendicular to said ink ribbon.

2. The tension device according to claim 1, wherein said projection includes two projections arranged at the same distance from a transveral center of the ink ribbon on said tension applying means.

3. The tension device according to claim 1, wherein said tension applying means is interposed between said platen and said take-up reel.

4. The tension device according to claim 1, wherein said tension applying means is provided on said thermal head.

5. A tension balancer for an ink ribbon adapted for a printer for thermally transferring an image onto the printing paper while moving the ink ribbon together with the printing paper, said printer including:

a platen for moving a piece of printing paper wound around the platen; and a thermal head for pressingly contacting the ink ribbon, interposed between a supply reel and a take-up reel, against the printing paper on an outer circumference of the platen;

said tension balancer comprising:

means for balancing transversal tension of said ink ribbon, said tension balancing means being interposed between said platen and said take-up reel, said tension balancing means including:

a ribbon balancer which is brought into contact with said ink ribbon over its full width; and a pivot disposed on a transveral center of said ink ribbon for rotatably supporting said ribbon balancer in a direction substantially perpendicular to said ink ribbon.

6. The tension balancer according to claim 5, wherein said ribbon balancer is provided on said thermal head.

7. A tension device for an ink ribbon adapted for a printer for thermally transferring an image onto the printing paper while moving the ink ribbon together with the printing paper, said printer including:

a platen for moving a piece of printing paper wound around the platen; and a thermal head for pressingly contacting the ink ribbon, interposed between a supply reel and a take-up reel, against the printing paper on an outer circumference of the platen;

said tension device comprising:

means for balancing transversal tension of said ink ribbon, said tension balancing means being interposed between said platen and said take-up reel, said balancing means being brought into contact at its front face with said ink ribbon over its full width; and a pivot disposed on a transveral center of said ink ribbon for rotatably supporting said ribbon balancer in a direction substantially perpendicular to said ink ribbon;

wherein at least one projection is provided on said end face of said tension balancing means.

8. The tension device according to claim 7, wherein said tension balancing means is supported rotatably about said pivot, arranged on a transveral center of said ink ribbon, in a direction substantially perpendicular to said ink ribbon.

9. The tension device according to claim 7, wherein said projection includes two projections arranged at the same distance from a transveral center of the ink ribbon on said tension applying means.

10. The tension device according to claim 7, wherein said tension applying means is interposed between said platen and said take-up reel.

11. The tension device according to claim 7, wherein said tension balancing means is provided on said thermal head.

* * * * *